US005791053A

United States Patent [19]

Koong

[11] Patent Number: 5,791,053

[45] Date of Patent: Aug. 11, 1998

[54] FOOD HANDLING UTENSIL

[76] Inventor: Shang Shi Koong, 26941 Jasper, Mission Viejo, Calif. 92691

[21] Appl. No.: 833,790

[22] Filed: Apr. 9, 1997

[51] Int. Cl.[6] ..... A47J 43/28

[52] U.S. Cl. ..... 30/142; 30/322; 30/324; 30/340; 294/99.2

[58] Field of Search ..... 30/322, 324, 340, 30/342, 149, 148, 147, 150, 123, 142, 137; 294/99.2

[56] References Cited

U.S. PATENT DOCUMENTS

| | | | |
|---|---|---|---|
| D. 76,013 | 8/1928 | Gordon . | |
| 1,323,619 | 12/1919 | Curtin | 30/324 |
| 3,014,277 | 12/1961 | Gerckler | 30/324 |
| 3,186,749 | 6/1965 | Dawes | 294/16 |
| 3,742,602 | 7/1973 | Brumwell | 30/340 |
| 4,314,724 | 2/1982 | Barna | 294/99.2 |
| 4,721,334 | 1/1988 | Nakatsu | 294/99.2 |
| 4,787,663 | 11/1988 | Laramie | 294/99.2 |
| 5,054,835 | 10/1991 | Loechel et al. | 294/99.2 |
| 5,206,998 | 5/1993 | Oriente et al. | 30/142 |
| 5,479,708 | 1/1996 | Thomas | 30/324 |

FOREIGN PATENT DOCUMENTS

| | | | |
|---|---|---|---|
| 2622496 | 5/1989 | France | 30/340 |
| 9580 | of 1909 | United Kingdom | 294/99.2 |

*Primary Examiner*—Hwei-Siu Payer

*Attorney, Agent, or Firm*—Stetina Brunda Garred & Brucker

[57] ABSTRACT

A food handling utensil having a handle component and a food engagement component constructed such that the handle component releasably retains the food engagement component. Food engagement components can include forks, knives, spoons, etc. which are retained by respective handle components to thereby provide table utensils used while eating. In another embodiment, the utensil incorporates two food engagement components such as forks and or spoons retained by two respective handle components, with a spring biasing component connected to the two handle components such that the handle components are held away from each other in a resting mode and are hand movable toward each other for use. This embodiment provides utility in grasping food items. The utensils of the present invention provide versatility for changes of handle appearance, replacement of damaged components, and/or requirements for small-space packing accommodations.

6 Claims, 3 Drawing Sheets

10
28
16
18a
12
28
16

18b
16
28
14

18c 10
18a
24
22
20
16
30
28
34

12
18b
24
22
20
16
30
28
34

14
18c
24
20
22
16
26
30
28
34

FOOD HANDLING UTENSIL

FIELD OF THE INVENTION

This invention relates in general to food utensils, and in particular to a food handling utensil having a handle component with a releasably retained food engagement component such as a fork, knife or spoon, and wherein the utensil optionally can have a spring biasing component to permit connection of two handle components such that opposing spring movement can occur and permit two food engagement components to cooperatively function in food retrieval and serving.

BACKGROUND OF THE INVENTION

Traditional food handling utensils such as knives, forks and spoons are each generally provided as one piece items having a handle portion and a food engagement portion. Examples of food engagement portions include a blade for knife functionality, tongs for fork functionality, and a concavity for spoon functionality, and all are permanently affixed to a handle portion. A similar situation occurs with respect to other utensils such as salad tongs or other spring-biased utensils employed to grasp food items for serving food or the like. These utensils generally are of one piece construction and have a tensioned U-shaped portion at a proximal site to impart spring resistance during utensil use and from which handle and food engagement components extend.

While single-piece construction provides utensils that have adequate utility for food handling, these utensils have no provision for versatility in appearance changes or in the ability to replace an inoperative portion thereof upon its breaking, bending, or the like. Thus, rather than being able to change a handle having a particular style with another handle of another style, a user must invest in a totally separate set of utensils. Likewise, if a tong of a fork bends or if a handle member becomes damaged, the utensil now must be discarded in its entirety instead of having the option of replacing only the ruined part. In view of these considerations, it is apparent that a need is present for food handling utensils that provide adaptability as desired by a user. Accordingly, a primary object of the present invention is to provide a food handling utensil having a handle portion and a food engagement portion that are releasable from each other.

Another object of the present invention is to provide such a food handling utensil wherein the food engagement portion is a fork, knife or spoon.

Yet another object of the present invention is to provide such a food handling utensil having opposing spring-biased members to thereby provide a grasping functionality for food handling.

These and other objects of the present invention will become apparent throughout the description thereof which now follows.

SUMMARY OF THE INVENTION

The present invention is a food handling utensil comprising a handle component and a food engagement component constructed such that the handle component releasably retains the food engagement component. Non-limiting examples of food engagement components include forks, knives, spoons, etc. which are retained, preferably by friction fit, by respective handle components to thereby provide table utensils used while eating. In another embodiment, the utensil comprises two food engagement components retained by two respective handle components, with a spring biasing component connected to the two handle components such that the handle components are held away from each other in a resting mode and are hand movable toward each other for use. As is apparent, this embodiment provides utility in grasping food items. The food engagement components of this embodiment can additionally and non-limitedly include opposing spatulas, inwardly-extending tongs, and any other components useable for grasping object.

The handle component of the utensil preferably is generally cylindrical in shape, with the distal end provided with an opening into which a projection from the food engagement component can be retained by friction fit. If the utensil is to be an opposing member of a spring-biased pair, then the proximal end of the handle component is compatible for securement to the spring-biasing component. Disengagement of the components from each other preferably is accomplished by an exteriorly accessible mechanical thruster that pushes the food engagement component from the handle component. As is apparent, the utensils of the present invention provide versatility for changes of handle appearance, replacement of damaged components, and/or requirements for small-space packing accommodations.

BRIEF DESCRIPTION OF THE DRAWINGS

An illustrative and presently preferred embodiment of the invention is shown in the accompanying drawings in which.

DETAILED DESCRIPTION OF THE PREFERRED EMBODIMENT

Figures 1A, 1B, 1C:
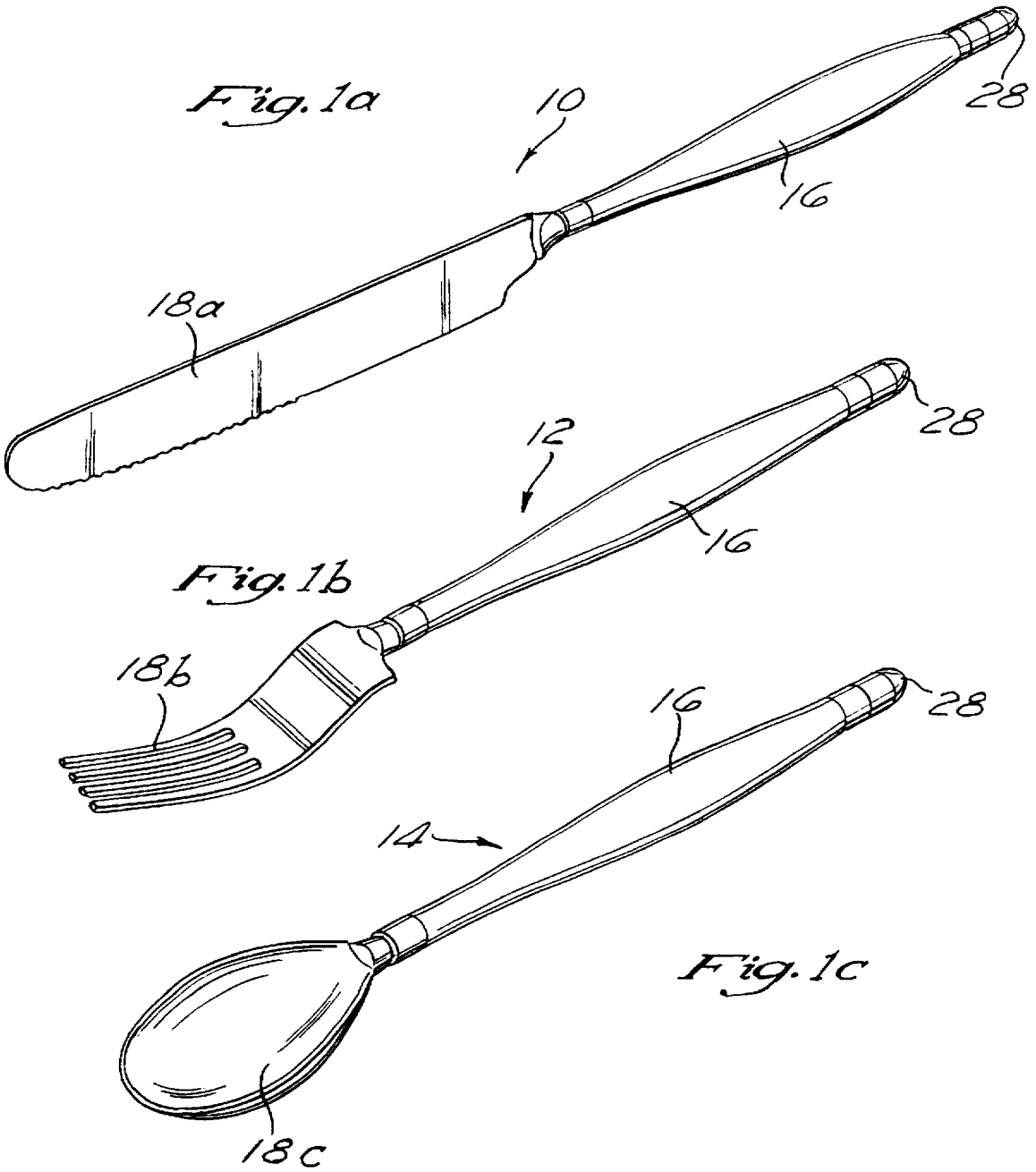
FIGS. 1*a*–1*c* are perspective views of food handling utensils configured as a knife, a fork, and a spoon, respectively, each having a handle component and a food engagement component.
Figures 2A, 2B, 2C:
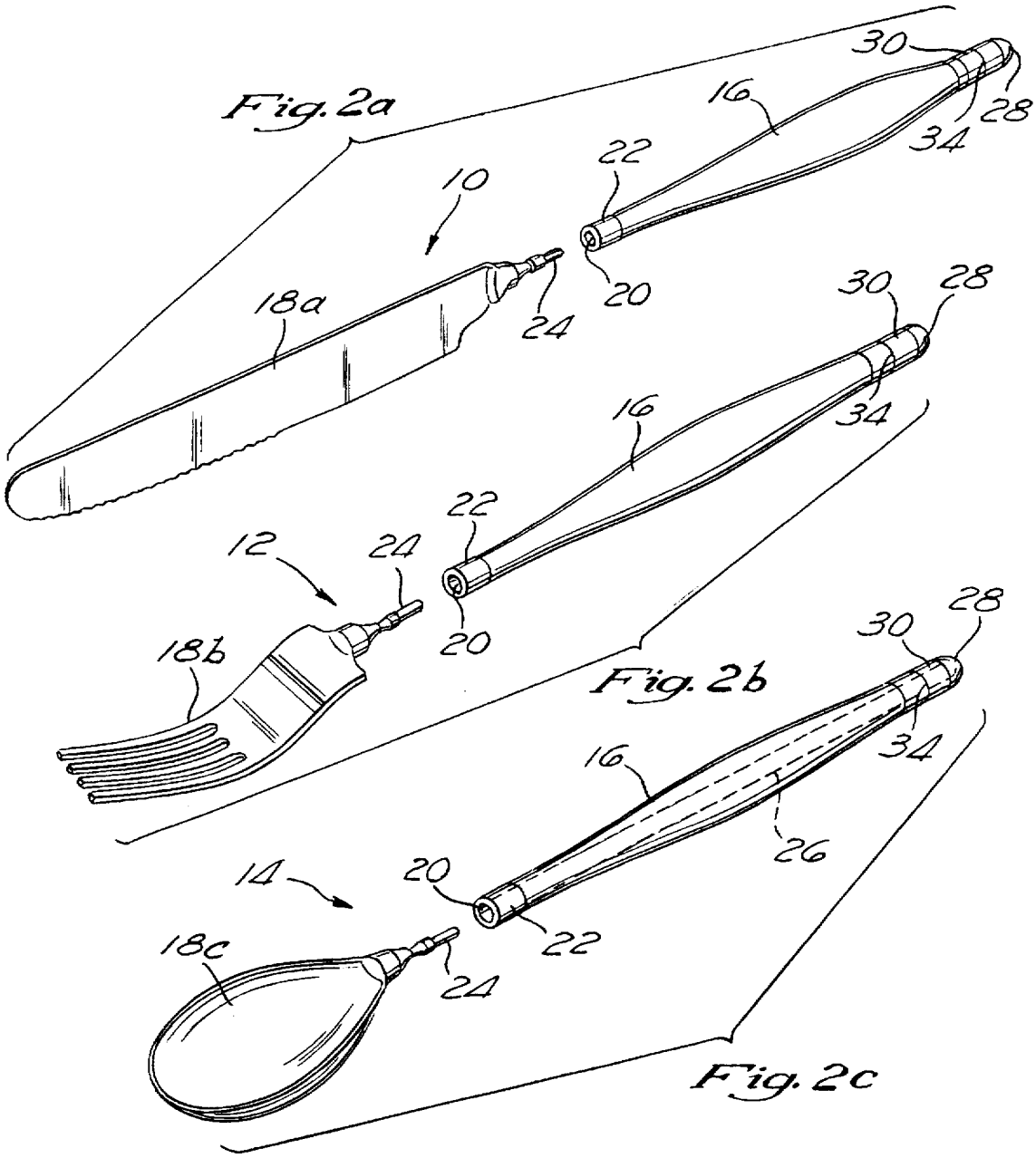
FIGS. 2*a*–2*c* are perspective views of the utensils of FIGS. 1*a*–1*c*, with the respective food engagement components shown removed from the handle components.

Referring to FIGS. 1*a*–1*c* and 2*a*–2*c*, food handling utensils 10, 12 and 14 are shown. Each utensil has a handle component 16 that releasably retains a food engagement component 18*a*, 18*b*, 18*c* by friction fit. Specifically, the handle component 16 has an opening 20 situated at its distal end 22, while each food engagement component 18*a*, 18*b*, 18*c* has a projection 24 complimentary in shape to the opening 20 and sized to be retained therein frictionally. Although the food engagement components 18*a*, 18*b*, 18*c* can be removed from the handle component 16 directly by hand, the preferred embodiment has a rod 26 extending within the handle 16 and having a proximal end 28 projecting from the proximal end 30 of the handle component 16. The distal end of the rod 26 is in contact with the projection 24 such that pushing the proximal end 28 of the rod 26 ejects the food engagement component 18*a*, 18*b*, 18*c* from the handle component 16. In this manner a food engagement component is easily removed for washing, storing, and the like by pushing the proximal end 28 of the rod 26.

Figure 3A:
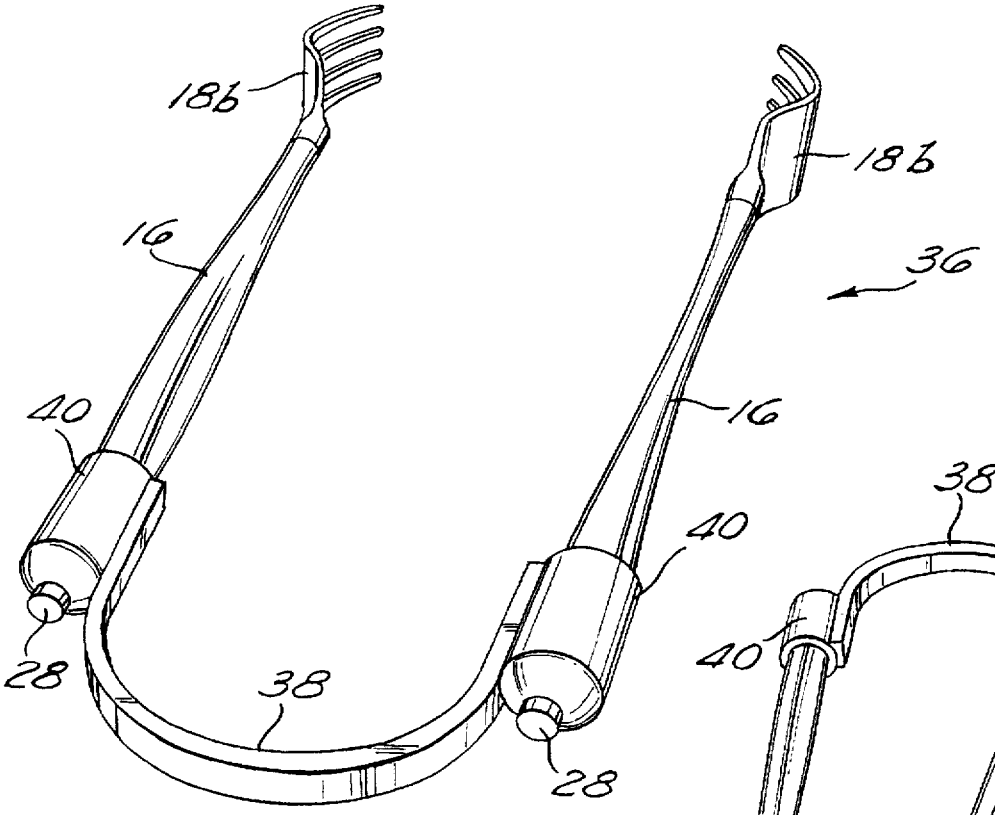
FIGS. 3*a* and 3*b* are perspective views of a food handling utensil having spring-tensioned opposing members and illustrating utensil operation.
Figure 3B:
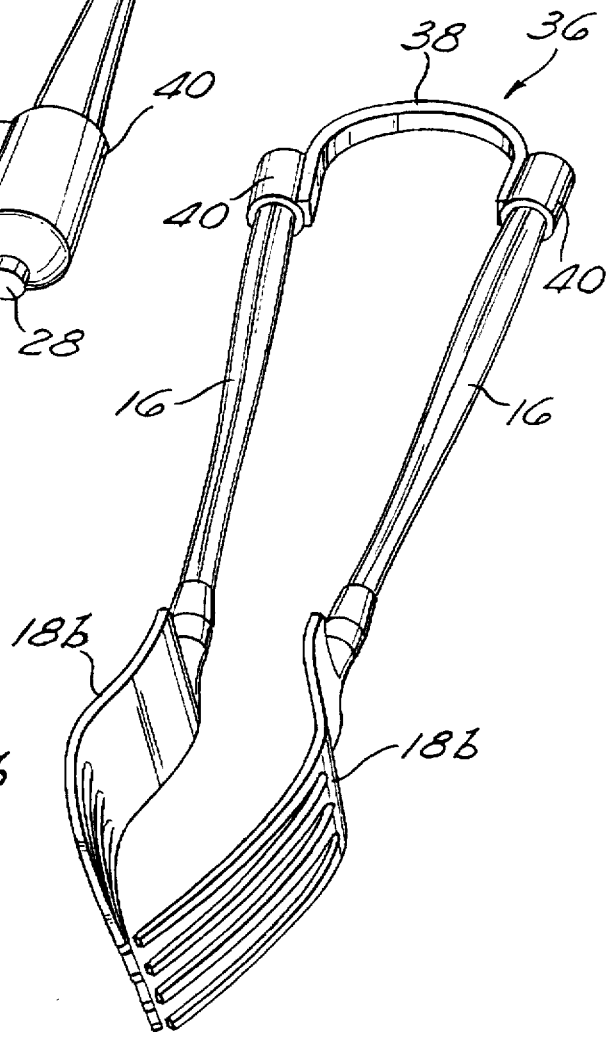

FIGS. 3*a* and 3*b* illustrate a second embodiment of a food handling utensil 36 comprising two food engagement components 18*b*, here each being forks, two handle components 16 retaining the food engagement components 18*b* therewith, and a U-shaped spring biasing component 38 releasably connected to the two handle components 16. The handle components 16 are held away from each other in a resting mode (FIG. 3*a*) and are hand movable toward each other (FIG. 3*b*) for use in grasping a food item (not shown). The spring biasing component 38 can be constructed of metal or plastic as would be recognized in the art, and has opposing openings to accept the proximal ends 30 of the two handle components 16. In the preferred embodiment, the openings are internally threaded sleeves 40, while the proximal ends 30 of the handle components 16 have corresponding threads 34 that permit threaded engagement in these openings. As is apparent, the utensil 36 can function as salad tongs, for example, and permits a user to hold and convey food items from one location to another.

In operation, a user inserts the projection 24 of the food engagement component 18*a*, 18*b* or 18*c* into the opening 20 of the handle component 16 to thereby form a usable food handling utensil 10, 12, 14, 36 as described above. Variously styled handle components, whether plastic, metal, or other appropriate material, can be employed as desired for practicality as well as desired appearance. By maintaining identical respective sizes of all openings 20 of all handle components and of all projections 24 of all food engagement components, interchangeability of components can be preserved while providing a broad scope of component selectivity.

While an illustrative and presently preferred embodiment of the invention has been described in detail herein, it is to be understood that the inventive concepts may be otherwise variously embodied and employed and that the appended claims are intended to be construed to include such variations except insofar as limited by the prior art.

What is claimed is:

1. A food handling utensil comprising:

a) two food engagement components;

b) two handle components each generally cylindrical in configuration, wherein each handle component has an opening and releasably retains one food engagement component, with each handle component having therein a pusher member having a first end adjacent a respective projection of each food engagement component within said opening and a second end exteriorly accessible and movable against said projection to thereby force and release each food engagement component from each handle component; and c) a spring biasing component releasably connected to the two handle components whereby the handle components are held away from each other in a resting mode and are hand movable toward each other for use.

2. A food handling utensil as claimed in claim 1 wherein the pusher member is a rod having a second end projecting proximally from the handle component.

3. A food handling utensil comprising:

a) two food engagement components;

b) two handle components, wherein each handle component has an opening and releasably retains one food engagement component, with each handle component having therein a pusher member having a first end adjacent a respective projection of each food engagement component within said opening and a second end exteriorly accessible and movable against said projection to thereby force and release each food engagement component from each handle component; and c) a spring biasing component releasably connected to the two handle components whereby the handle components are held away from each other in a resting mode and are hand movable toward each other for use.

4. A food handling utensil comprising a handle component and a food engagement component, wherein the handle component has an opening and releasably retains the food engagement component, and wherein the food engagement component has a projection complimentarily shaped to said opening and retainable therein by friction fit, with said handle component being generally cylindrical in configuration and having therein a pusher member having a first end adjacent the projection of the food engagement component within said opening and a second end exteriorly accessible and movable against said projection to thereby force and release the food engagement component from the handle component.

5. A food handling utensil as claimed in claim 4 wherein the pusher member is a rod having a second end projecting proximally from the handle component.

6. A food handling utensil comprising a handle component and a food engagement component, wherein the handle component has an opening and releasably retains the food engagement component, and wherein the food engagement component has a projection complimentarily shaped to said opening and retainable therein by friction fit, with said handle component having therein a pusher member having a first end adjacent the projection of the food engagement component within said opening and a second end exteriorly accessible and movable against said projection to thereby force and release the food engagement component from the handle component.

* * * * *